US010052002B2

(12) United States Patent
Andrews et al.

(10) Patent No.: US 10,052,002 B2
(45) Date of Patent: Aug. 21, 2018

(54) POWER HEAD FOR VACUUM SYSTEMS

(71) Applicant: Tiger Tool International Incorporated, Abbotsford (CA)

(72) Inventors: Michael Andrews, Bellingham, WA (US); Doddy Ervondy, Surrey (CA)

(73) Assignee: Tiger Tool International Incorporated, Abbotsford (CA)

( * ) Notice: Subject to any disclaimer, the term of this patent is extended or adjusted under 35 U.S.C. 154(b) by 112 days.

(21) Appl. No.: 15/302,717

(22) PCT Filed: Apr. 6, 2015

(86) PCT No.: PCT/US2015/024576
§ 371 (c)(1),
(2) Date: Oct. 7, 2016

(87) PCT Pub. No.: WO2015/157196
PCT Pub. Date: Oct. 15, 2015

(65) Prior Publication Data

US 2017/0027398 A1 Feb. 2, 2017

Related U.S. Application Data

(60) Provisional application No. 61/976,403, filed on Apr. 7, 2014.

(51) Int. Cl.
*A47L 9/04* (2006.01)
*A47L 5/36* (2006.01)
(Continued)

(52) U.S. Cl.
CPC ..... *A47L 9/0477* (2013.01); *A47L 5/362* (2013.01); *A47L 9/0411* (2013.01);
(Continued)

(58) Field of Classification Search
CPC .... A47L 9/0477; A47L 9/0411; A47L 9/0438; A47L 9/0455; A47L 9/0494; A47L 9/0673; A47L 9/28; A47L 9/2873; A47L 9/2884
See application file for complete search history.

(56) References Cited

U.S. PATENT DOCUMENTS 2,718,655 A 9/1955 Cymara
2,953,806 A 9/1960 Walker
(Continued)

FOREIGN PATENT DOCUMENTS

CA 675552 A 12/1963
CN 105338869 A 2/2016
(Continued)

OTHER PUBLICATIONS

Australian Government IP Australia, "Examination Report", Application No. 2014238009, Nov. 30, 2017, 3 pages.
(Continued)

*Primary Examiner* — Dung Van Nguyen
(74) *Attorney, Agent, or Firm* — Michael R. Schacht; Schacht Law Office, Inc.

(57) ABSTRACT

A power head for use with a vacuum system. The power head comprises a main body assembly, a brush assembly, and a latch system. The latch system detachably attaches the brush assembly to the main body assembly such that a main inlet portion of the main chamber is in fluid communication with a brush outlet and the battery is operatively connected to the motor. When the vacuum system is detachably attached to the main housing and the latch system detachably attaches the main housing to the brush housing, the vacuum system draws air through a brush inlet, a brush chamber, the brush outlet, the main inlet, a main chamber, and a main outlet and the battery supplies power to the motor
(Continued)

such that the motor rotates the brush assembly relative to the brush housing.

18 Claims, 12 Drawing Sheets

(51) Int. Cl.
*A47L 9/28* (2006.01)
*A47L 9/06* (2006.01)

(52) U.S. Cl.
CPC ..... *A47L 9/0438* (2013.01); *A47L 9/0455* (2013.01); *A47L 9/0494* (2013.01); *A47L 9/0673* (2013.01); *A47L 9/28* (2013.01); *A47L 9/2873* (2013.01); *A47L 9/2884* (2013.01)

(56) References Cited

U.S. PATENT DOCUMENTS 3,027,588 A 4/1962 Bierstock
3,353,996 A 11/1967 Hamrick
3,520,725 A 7/1970 Hamrick
3,568,240 A 3/1971 Hamrick
3,682,500 A 8/1972 Hamrick
4,050,113 A 9/1977 Wright et al.
5,402,551 A 4/1995 Workhoven et al.
5,455,982 A 10/1995 Armstrong et al.
5,526,842 A 6/1996 Christensen
5,740,581 A 4/1998 Harrelson, II
5,740,582 A 4/1998 Harrelson, II
5,794,305 A 8/1998 Weger
5,960,514 A 10/1999 Miller et al.
6,323,570 B1 * 11/2001 Nishimura ..... A47L 5/28 15/392
6,382,241 B1 5/2002 Setrum
6,427,284 B1 8/2002 Harrelson, II et al.
6,763,549 B1 7/2004 Peters
7,010,829 B2 3/2006 Harman et al.
7,322,070 B2 1/2008 Zimmerle et al.
7,343,640 B1 3/2008 Robertson
7,549,448 B2 6/2009 Ragner
8,001,650 B2 8/2011 Trotter
8,776,310 B2 7/2014 Genn et al.
8,898,858 B2 * 12/2014 Dyson ..... A47L 9/0411 15/375
D729,447 S 5/2015 Gammack
D729,448 S 5/2015 Gammack
D729,978 S 5/2015 Bates et al.
D729,979 S 5/2015 Gammack
D730,575 S 5/2015 Bates et al.
D730,576 S 5/2015 Gammack
D731,117 S 6/2015 Bates et al.
9,049,971 B2 6/2015 Andrews
9,375,121 B2 6/2016 Coesel
9,609,988 B2 4/2017 Andrews
2003/0051301 A1 3/2003 Morgan et al.
2005/0022329 A1 2/2005 Harman et al.
2005/0160555 A1 * 7/2005 Mayes ..... A47L 5/30 15/384
2007/0174991 A1 8/2007 Trotter
2009/0188073 A1 7/2009 Gabric et al.
2010/0050373 A1 3/2010 Kaffenberger et al.
2011/0041282 A1 2/2011 Smith et al.
2011/0119860 A1 5/2011 Marcil et al.
2011/0219566 A1 9/2011 Dyson et al.
2011/0303239 A1 * 12/2011 Harrison ..... A47L 5/30 134/6
2012/0079671 A1 4/2012 Stickney et al.
2012/0167331 A1 * 7/2012 Pruiett ..... A47L 5/30 15/319
2014/0246942 A1 9/2014 Greetham et al.
2014/0312813 A1 10/2014 Murchie et al.
2014/0319955 A1 10/2014 Leaver et al.
2014/0325789 A1 11/2014 Hill et al.
2014/0328670 A1 11/2014 Lamb
2014/0328674 A1 11/2014 Jacob et al.
2014/0328676 A1 11/2014 Robson et al.
2014/0328683 A1 11/2014 King et al.
2014/0328684 A1 11/2014 King et al.
2014/0366495 A1 12/2014 Stickney et al.
2014/0368136 A1 12/2014 Celik et al.
2014/0368138 A1 12/2014 Celik et al.
2014/0368139 A1 12/2014 Zhou et al.
2014/0368140 A1 12/2014 Celik
2014/0368141 A1 12/2014 Zheng et al.
2014/0368144 A1 12/2014 Celik
2015/0007442 A1 1/2015 Gammack et al.
2015/0007443 A1 1/2015 Gammack et al.
2015/0007444 A1 1/2015 Moloney et al.
2015/0007854 A1 1/2015 Moloney et al.
2015/0007855 A1 1/2015 Moloney et al.
2015/0008855 A1 1/2015 Zheng et al.
2015/0017028 A1 1/2015 Hodgson et al.
2015/0020401 A1 1/2015 Atkinson
2015/0021314 A1 1/2015 Coulton et al.
2015/0026993 A1 1/2015 Sutter et al.
2015/0033498 A1 2/2015 McVey
2015/0082652 A1 3/2015 Atkinson
2015/0084214 A1 3/2015 Wilson et al.
2015/0107048 A1 4/2015 Thompson et al.
2015/0113762 A1 4/2015 Robertson
2015/0135429 A1 5/2015 Dyson
2015/0138692 A1 5/2015 Amaratunga et al.
2015/0155606 A1 6/2015 Stickney et al.
2015/0157106 A1 6/2015 Atkinson
2015/0157107 A1 6/2015 Gosnay et al.
2015/0164287 A1 6/2015 MacLaine et al.
2015/0164288 A1 6/2015 Courtney
2015/0164289 A1 6/2015 Courtney
2015/0182086 A1 7/2015 Dimbylow et al.
2015/0190025 A1 7/2015 Dimbylow et al.
2015/0190026 A1 7/2015 Dimbylow et al.
2015/0216382 A1 8/2015 Bower et al.
2015/0216383 A1 8/2015 Bower et al.
2015/0216384 A1 8/2015 Bower et al.
2015/0223654 A1 8/2015 Ventress et al.
2015/0223655 A1 8/2015 Cole et al.
2015/0223656 A1 8/2015 Tucker et al.
2016/0302632 A1 10/2016 Coesel
2017/0202415 A1 7/2017 Andrews

FOREIGN PATENT DOCUMENTS

JP 2000342363 A 12/2000
JP 2001161619 A 6/2001
JP 2002000516 A 1/2002
JP 2002000516 8/2002
JP 2003164395 A 6/2003
WO 2013142992 A1 10/2013
WO 2015157196 A1 10/2015

OTHER PUBLICATIONS

European Patent Office, "Communication pursuant to Article 94(3) EPC", EP13769460.0-1731, Dec. 19, 2017, 4 pages.
International Searching Authority, International Search Report, PCT/US/2015024576, dated Jul. 9, 2015, 7 pages.
Japanese Patent Office, "Official Action", Application No. 2016-500522, dated Mar. 19, 2018, 9 pages.
European Patent Office, "Extended European Search Report", Application No. 15777394.6, dated Mar. 23, 2018, 6 pages.

* cited by examiner

POWER HEAD FOR VACUUM SYSTEMS

RELATED APPLICATIONS

This application, U.S. patent application Ser. No. 15/302,717 filed Oct. 7, 2016, is a 371 of International PCT Application No. PCT/US2015/024576 filed Apr. 6, 2015, now expired.

International PCT Application No. PCT/US2015/024576 claims benefit of U.S. Provisional Patent Application Ser. No. 61/976,403 filed Apr. 7, 2014.

The contents of all related applications are incorporated herein by reference.

TECHNICAL FIELD

The present invention relates to central vacuum cleaning systems and, in particular, to power head systems and methods for central vacuum systems.

BACKGROUND

Vacuum systems are of several basic types. One type is an upright vacuum cleaner. The vacuum system of an upright vacuum cleaner is mounted in a housing that may be moved across the surface to be cleaned. Another type is a central vacuum cleaner in which the vacuum system is arranged at a central location and one or both of rigid pipe or flexible hose extends from the vacuum system to the location of the surface to be cleaned. Yet another type of vacuum cleaner is a canister vacuum cleaner in which the vacuum system is mounted on wheels, and a hose extends from the vacuum system to allow the vacuum to be applied to the surface to be cleaned. It is possible to combine these types of vacuum cleaners. For example, and upright vacuum cleaner may be provided with a hose to facilitate the application of the vacuum to surfaces over which the main portion of the upright vacuum cleaner may not be moved.

Any type of vacuum cleaners that uses a hose may also include a vacuum head to facilitate the removal of debris from the surface to be cleaned. The vacuum heads typically contain a brush. A brush on a vacuum head may be fixed or may move (e.g., rotated) to facilitate the lifting of debris from the surface to be cleaned. A moving brush may be powered by the movement of air drawn through the vacuum head by the vacuum system or may be motorized. Commonly, a short, helical brush is mounted on a shaft supported parallel to the surface to be cleaned for rotation by a motor.

The present invention is of particular significance when applied to a motorized brush adapted for use with a central vacuum cleaner, but the principles of the present invention may have application to other types of vacuum cleaners using a vacuum head.

A motorized vacuum head designed for use with a central vacuum cleaner is typically referred to as a power head. A power head may be configured to obtain power from wires supported by the hose or by a battery contained within a housing of the power head. The need exists for improved power heads for central vacuum cleaners.

SUMMARY

The present invention may be embodied as a power head for use with a vacuum system comprising a main body assembly, a brush assembly, and a latch system. The main body assembly comprises a main housing and a battery. The main housing defines a main chamber defining a main inlet and a main outlet and a battery chamber. The battery is arranged in the battery chamber. The brush assembly comprising a brush housing, a brush, and a motor. The brush housing defines a brush chamber, a brush inlet, and a brush outlet. The brush is rotatably supported within the brush chamber. The motor is arranged to rotate the brush assembly relative to the brush housing. The latch system detachably attaches the brush assembly to the main body assembly such that the main inlet portion of the main chamber is in fluid communication with the brush outlet and the battery is operatively connected to the motor. When the vacuum system is detachably attached to the main housing and the latch system detachably attaches the main housing to the brush housing, the vacuum system draws air through the brush inlet, the brush chamber, the brush outlet, the main inlet, the main chamber, and the main outlet, and the battery supplies power to the motor such that the motor rotates the brush assembly relative to the brush housing.

The present invention may also be embodied as a method of directing air and debris into a vacuum system comprising the following steps. A main body assembly is provided. The main body assembly comprises a main housing and a battery. The main housing defines a main chamber defining a main inlet and a main outlet and a battery chamber. The battery is arranged in the battery chamber. A brush assembly is provided. The brush assembly comprises a brush housing, a brush, and a motor. The brush housing defines a brush chamber, a brush inlet, and a brush outlet. The brush is rotatably supported within the brush chamber. The motor is arranged to rotate the brush assembly relative to the brush housing. The brush assembly is detachably attached to the main body assembly such that the main inlet portion of the main chamber is in fluid communication with the brush outlet and the battery is operatively connected to the motor. Operating the vacuum system draws air through the brush inlet, the brush chamber, the brush outlet, the main inlet, the main chamber, and the main outlet. The battery is connected to the motor such that the motor rotates the brush assembly relative to the brush housing.

The present invention may also be embodied as a vacuum system comprising a vacuum source, a hose connected to the vacuum source, a handle connected to the hose, an extension tube connected to the handle, and a power head. The power head comprises a main body assembly, a brush assembly, and a latch system. The main housing defines a main chamber defining a main inlet and a main outlet and a battery chamber. The battery is arranged in the battery chamber. The brush assembly comprises a brush housing defining a brush chamber, a brush inlet, and a brush outlet, a brush rotatably supported within the brush chamber, and a motor arranged to rotate the brush assembly relative to the brush housing. The latch system detachably attaches the brush assembly to the main body assembly such that the main inlet portion of the main chamber is in fluid communication with the brush outlet and the battery is operatively connected to the motor. When the extension tube is detachably attached to the main housing and the latch system detachably attaches the main housing to the brush housing, the vacuum source draws air through the brush inlet, the brush chamber, the brush outlet, the main inlet, the main chamber, the main outlet, the extension tube, the handle, and the hose and the battery supplies power to the motor such that the motor rotates the brush assembly relative to the brush housing.

DETAILED DESCRIPTION

Figure 1:
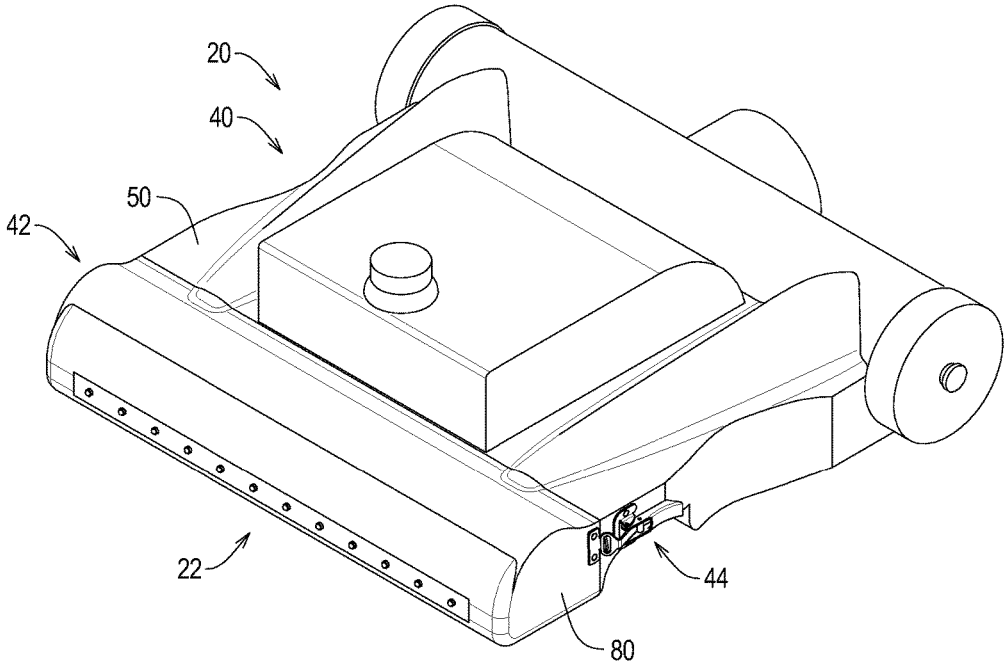
FIG. 1 is a perspective view of a first example power head of the present invention.
Figure 2:
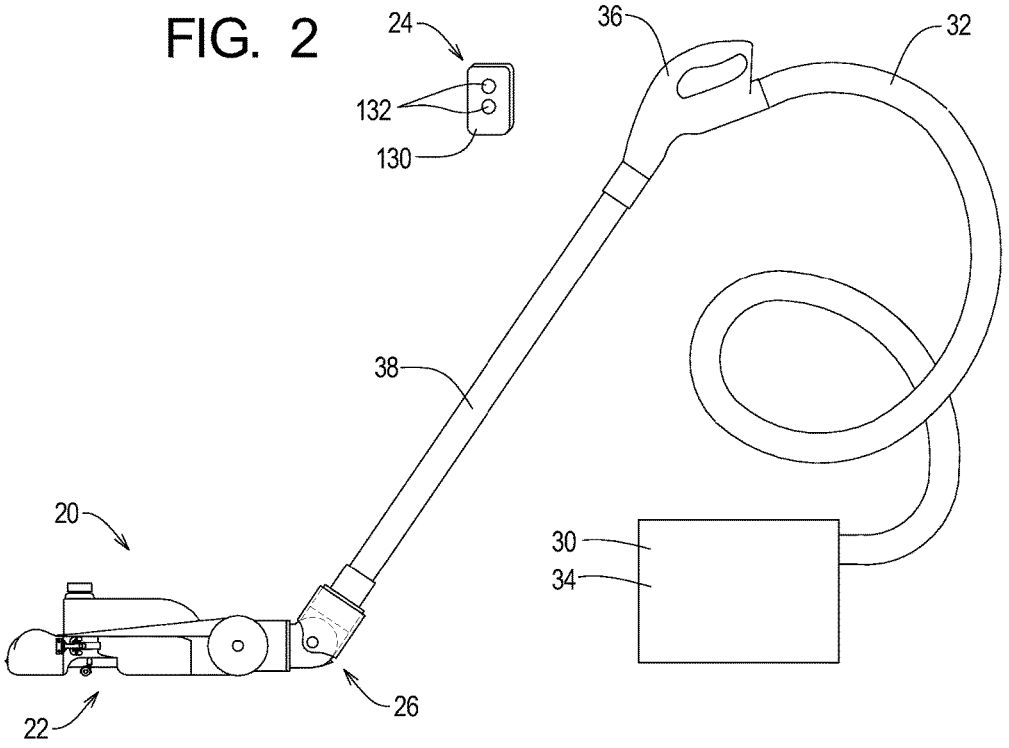
FIG. 2 illustrates the first example power head attached to an example vacuum assembly using a handle adapter system.
Figure 2A:
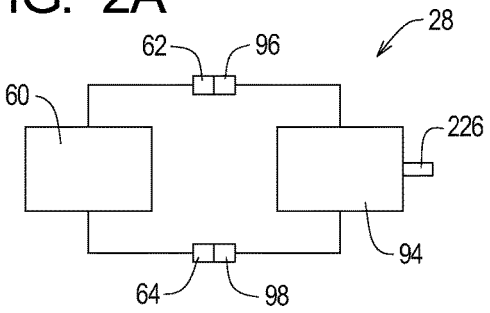
FIG. 2A illustrates an example electrical system of the first example power head in use mode.

Referring initially to FIG. 1 of the invention, depicted at 20 therein is a first example power head system constructed in accordance with, and embodying, the principles of the present invention. The example power head system 20 comprises a power head 22 (FIG. 2), a power head remote 24 (FIG. 2), and a power head adapter system 26 (FIG. 2). FIG. 2A illustrates an electrical system 28 forming part of the power head system 20.

The first example power head system 20 is adapted to be used as part of a vacuum system 30. The vacuum system 30 comprises a hose 32 connected between a vacuum source 34 and a handle 36. An extension tube 38 is connected between the handle 36 and the power head system 20. As is conventional, when connected together as shown in FIG. 2, the hose 32, handle 36, and extension tube 38 define a vacuum passage that extends between vacuum source 34 and the power head system 20.

The first example power head 22 comprises a main body assembly 40, a brush assembly 42, and a latch system 44 for detachably attaching the brush assembly 42 to the main body assembly 40.

Figure 2B:
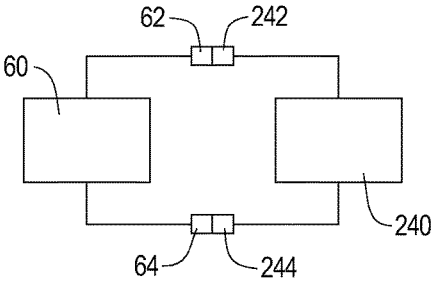
FIG. 2B illustrates the example electrical system of the first example power head in a charge mode.
Figure 3:
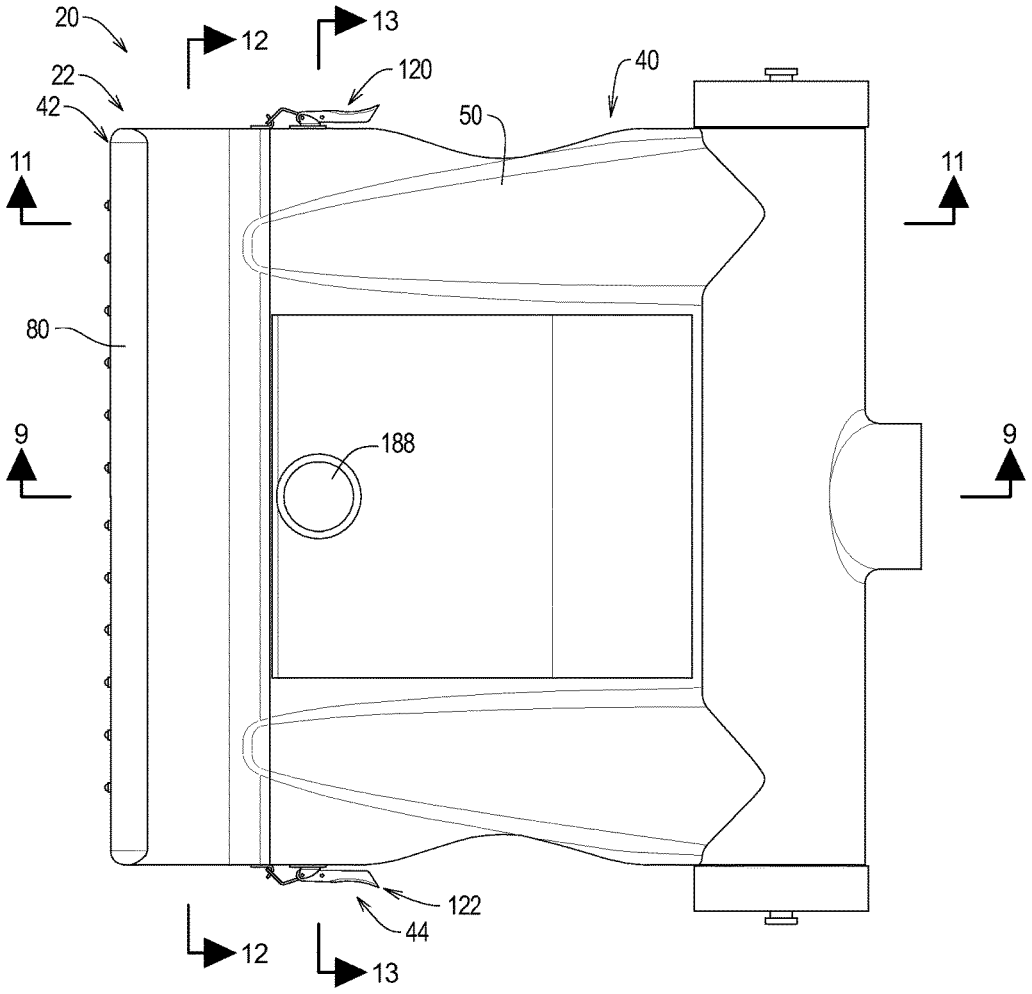
FIG. 3 is a top plan view of the first example power head in a first configuration.
Figure 7:
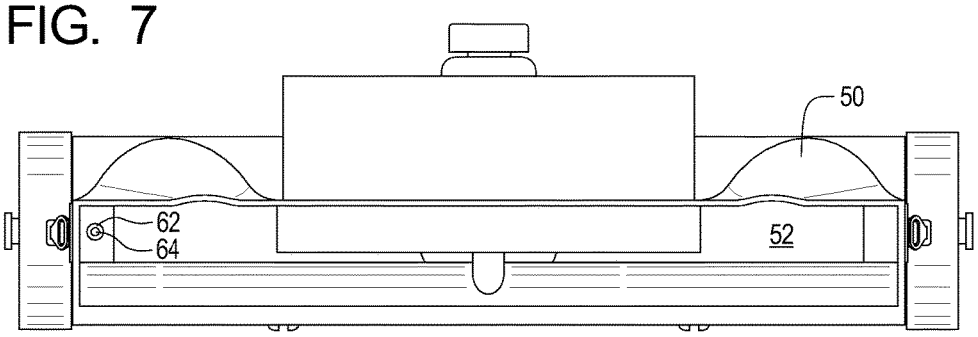
FIG. 7 is a front elevation view taken along lines 7-7 in FIG. 4 depicting the first example power head in the second configuration.
Figure 8:
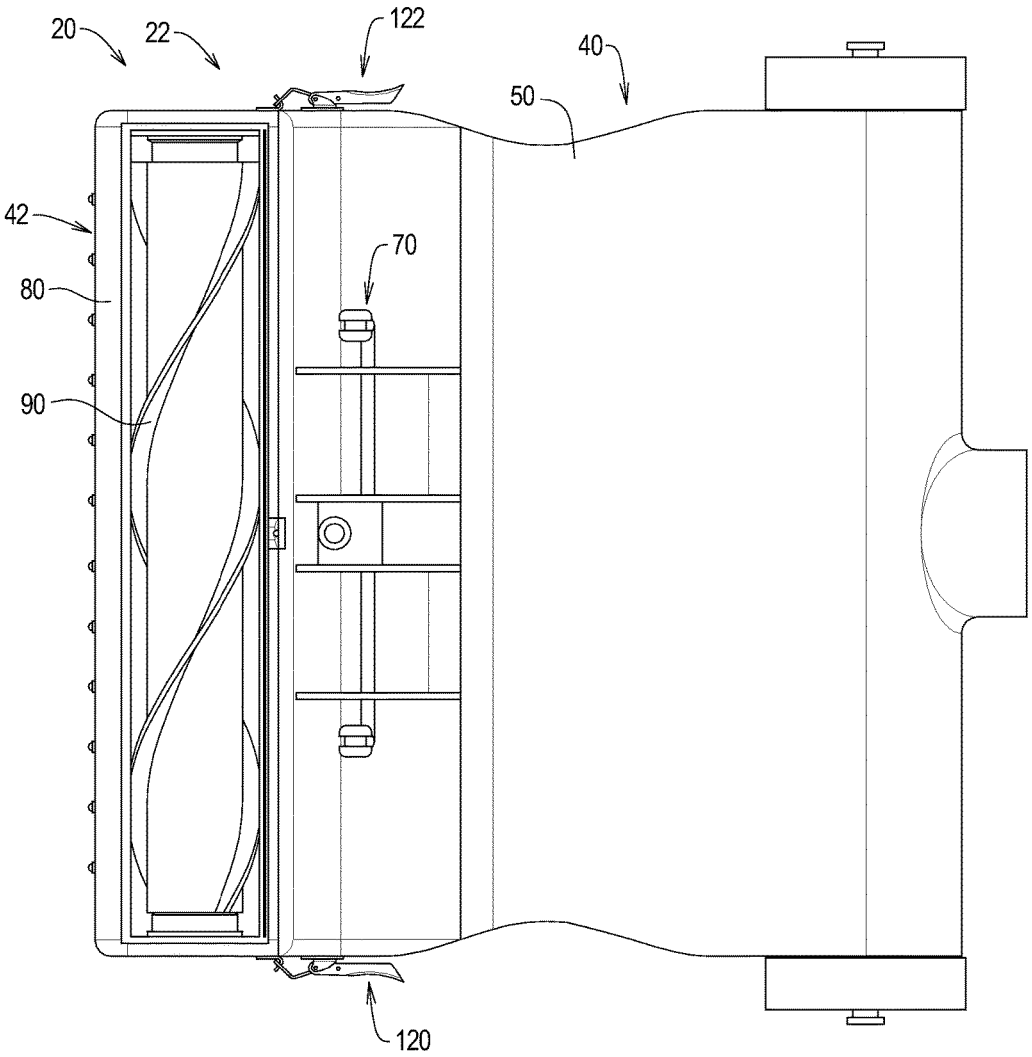
FIG. 8 is a bottom plan view of the first example power head in the first configuration.

The main body assembly 40 comprises a main housing 50 defining a main chamber 52 and a battery chamber 54. The main chamber 52 defines a main inlet 56 and a main outlet 58. The example battery chamber 54 is isolated from the main chamber 52 and is adapted to contain a battery assembly 60. As shown in FIGS. 2A and 2B, first and second main contacts 62 and 64 are electrically connected to the battery assembly 60. The first and second main contacts 62 and 64 may be embodied in any number of physical forms, but one common form is as an electrical socket mounted on the main housing 50 as depicted in FIG. 7. The example main body assembly 40 further comprises a wheel assembly 70 comprising wheels 72, a wheel carriage 74, and a wheel shaft 76.

Figure 4:
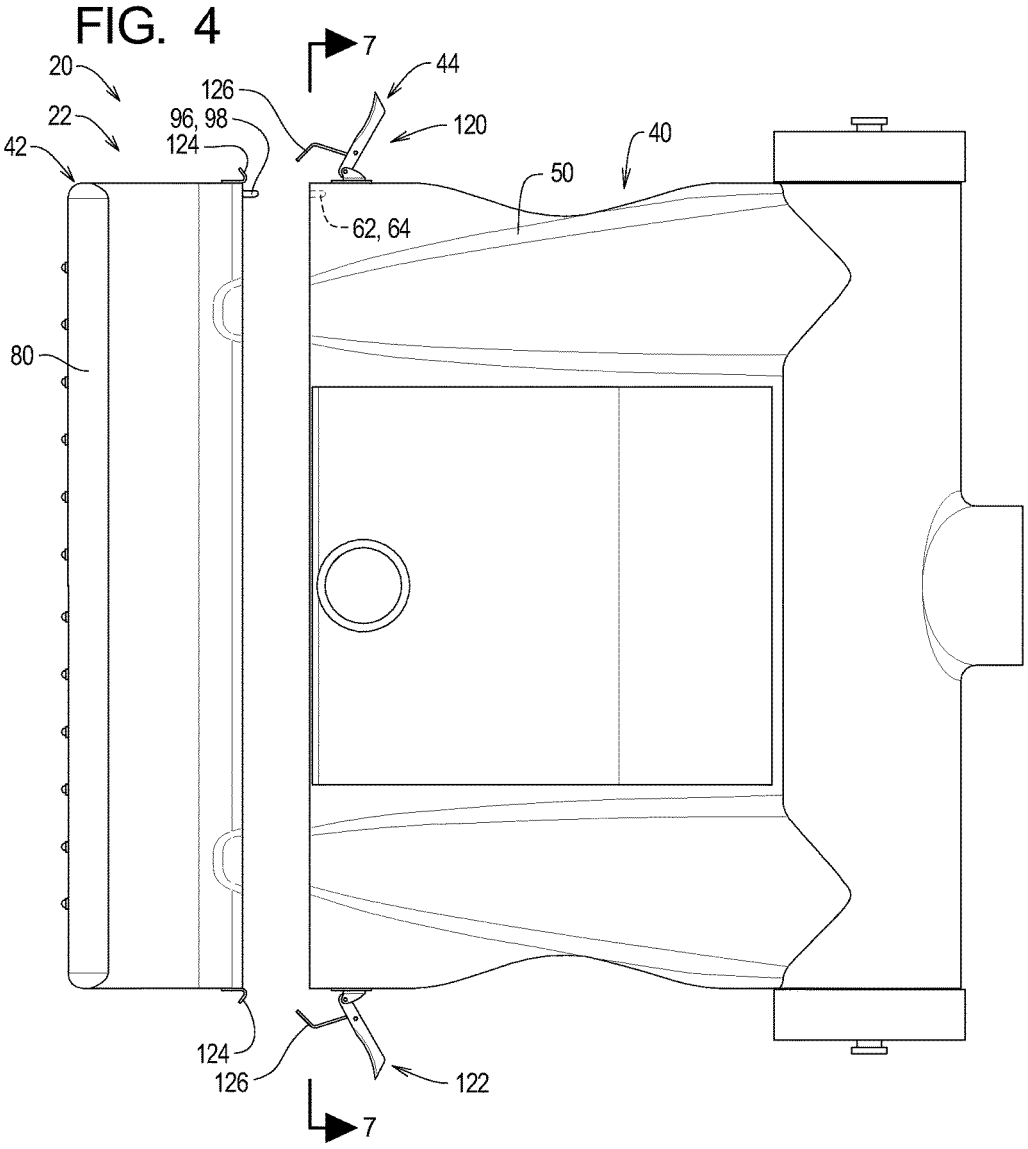
FIG. 4 is a top plan view of the first example power head in a second configuration.
Figure 5:
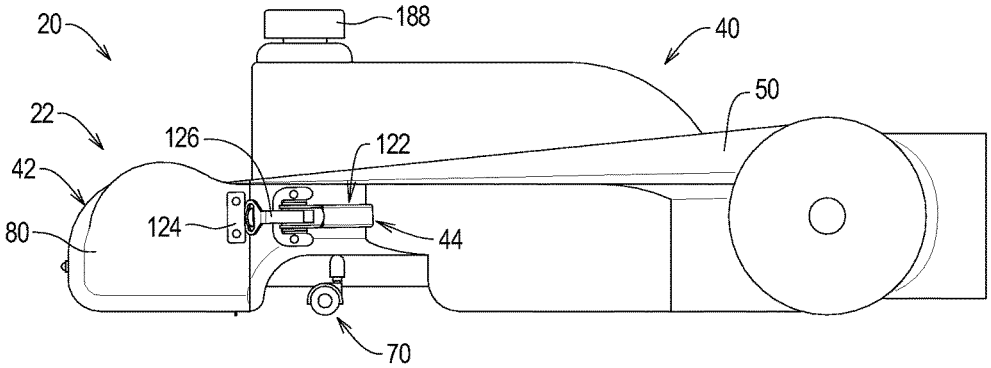
FIG. 5 is a side elevation view of the first example power head in the first configuration, the opposite side elevation view being reversed.
Figure 6:
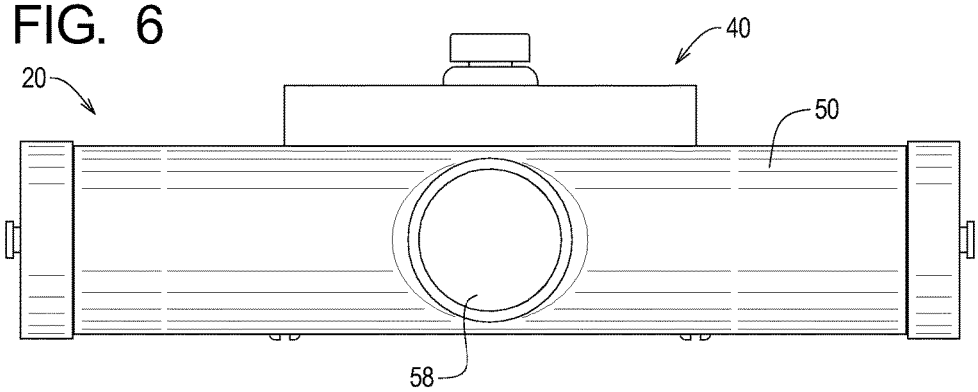
FIG. 6 is a rear elevation view of the first example power head in the first configuration.

The brush assembly 42 comprises a brush housing 80 defining a brush chamber 82. The brush chamber 82 defines a brush inlet 84 and a brush outlet 86. The brush assembly 42 further comprises a brush 90 arranged within the brush chamber 82 and a brush drive system 92. The brush drive system 92 comprises a brush motor 94. The example brush drive motor 94 is electrically connected to first and second brush contacts 96 and 98 as shown in FIG. 2A. The first and second brush contacts 96 and 98 may also take many different physical forms and are depicted in FIG. 4 as an electrical plug. The electrical plug formed by the brush contacts 96 and 98 is configured to engage the electrical socket formed by the main contacts 62 and 64 such that the battery assembly 60 provides power to the brush motor 94.

The example latch system 44 comprises a first latch assembly 120 and a second latch assembly 122. The example latch assemblies 120 and 122 are identical, and, as depicted in FIG. 4, the example latch assembly 120 comprises a latch anchor 124 rigidly secured to the brush housing 80 and a latch arm assembly 126 rotatably attached to the main housing 50. The example latch arm assembly 126 rotates between locked and unlocked position to detachably secure the brush housing 80 to the main housing 50. The latch assemblies 120 and 122 may take other forms. For example, the example latch assemblies 120 and/or 122 may be embodied as a detent member integrally formed with one of the main housing 50 and the brush housing 80 and a latch opening integrally formed in the other of the main housing 50 and the brush housing 80. In this form, the detent member defining a cam surface displaces the detent member to allow a detent projection on the detent member to enter the latch opening.

The latch assemblies 120 and 122 are configured to detachably attach the brush housing 80 to the main housing 50. When the brush housing 80 is attached to the main housing 50, the brush outlet 86 is in fluid communication with the main inlet 58, and a power head flow path is defined. The power head flow path extends from the brush inlet 84, through the brush chamber 82, through the brush outlet 86, through the main inlet 56, through them main chamber 52, and out of the main outlet 58.

The example power head remote 24 comprises a remote housing 130 and one or more remote buttons 132. A wireless communication system (not shown) formed by the electrical system 28 and the remote 24 allows the brush motor 94 to be turned on and off using the remote button(s) 132. The wireless communications system is or may be conventional and will not be described herein in detail.

The example adapter system 26 comprises a fixed member 140, a movable member 142, a first adapter member 144, and a second adapter member 146. The example fixed member 140 is sized and dimensioned to engage the main housing 50. The movable member 142 is rotatably supported by the fixed member 140 and is sized and dimensioned to receive the extension tube 38. The extension tubes 38 may come in different sizes and/or styles, and the first and second adapter members 144 and 146 are sized and dimensioned to engage the movable member 142 on one end and a selected size and/or style of the extension tube 38. The example adapter 26 may take a number of different configurations, but in each configuration the adapter system forms a substantially air-tight connection between one size and/or style of the extension tubes 38 and the main housing 50. When the adapter system 26 is formed between the extension tube 38 and the main housing 50, the vacuum source 34 causes air to flow through the main inlet 56, through the main chamber 52, and out of the main outlet 58.

Figure 9:
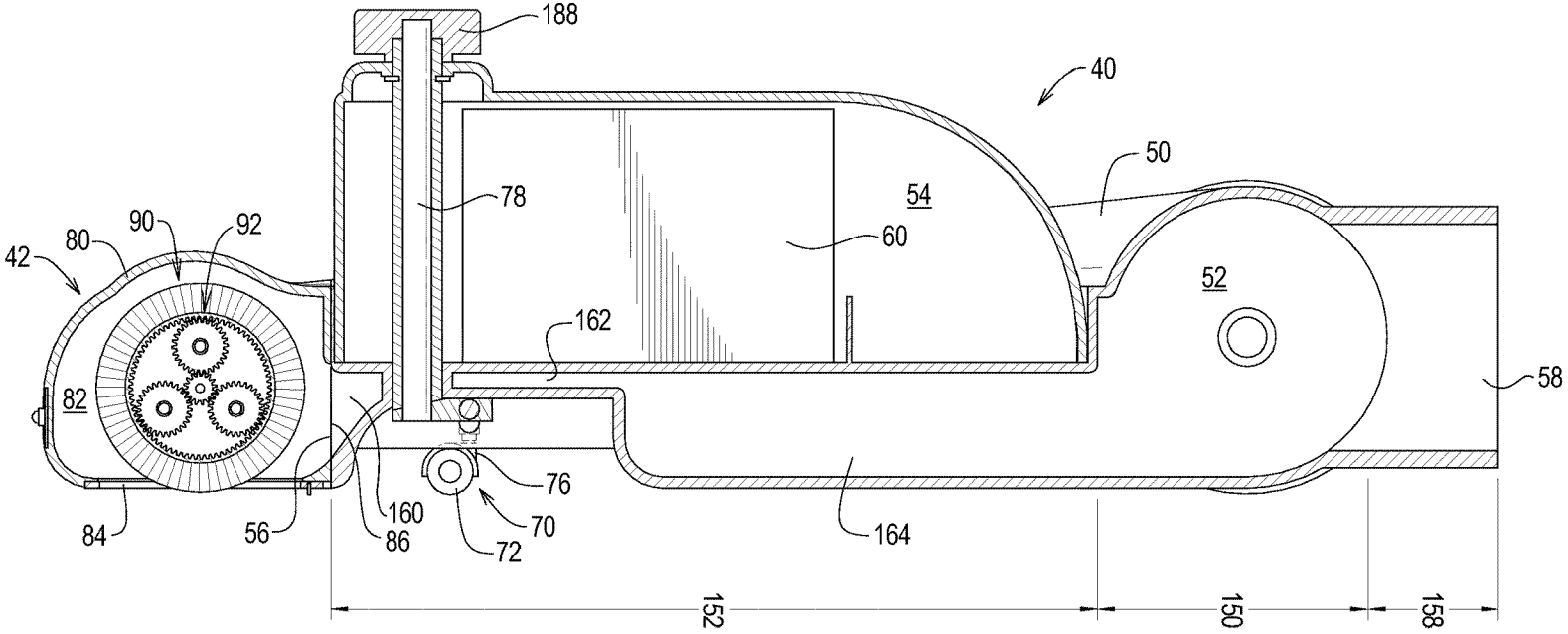
FIG. 9 is a side elevation, cutaway view taken along lines 9-9 in FIG. 3 depicting the first example power head in the first configuration.
Figure 11:
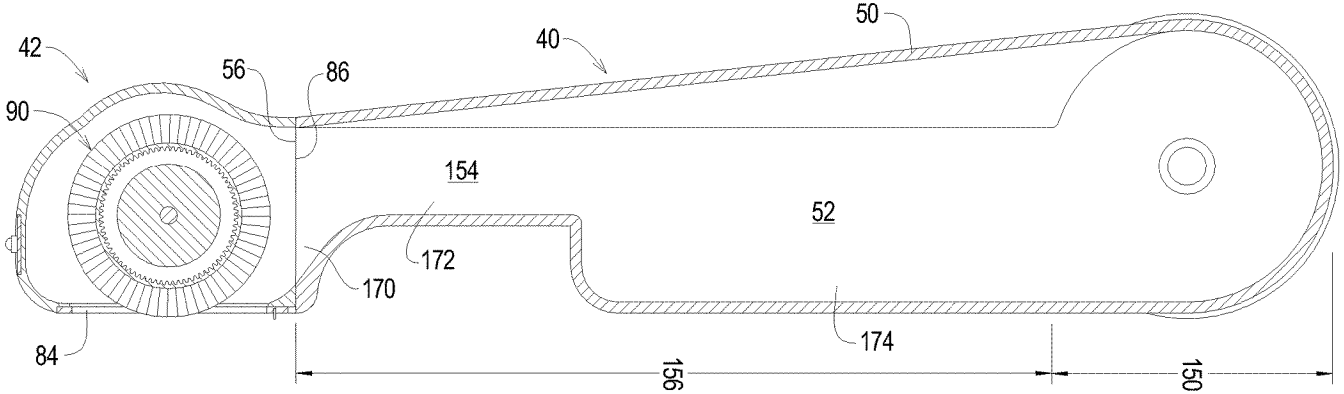
FIG. 11 is a side elevation, cutaway view taken along lines 11-11 in FIG. 3 depicting the first example power head in the first configuration.
Figure 13:
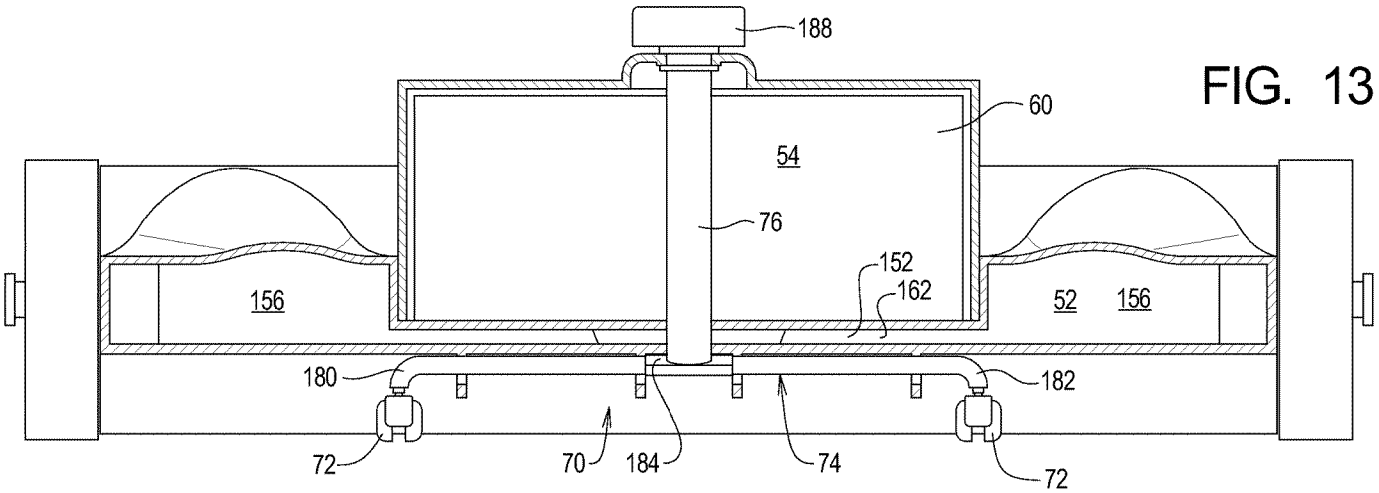
FIG. 13 is a front elevation, cutaway view taken along lines 13-13 in FIG. 3 depicting side air chambers and a battery storage compartment of the first example power head.

Referring now more specifically to the main chamber 52, FIGS. 9, 11, and 13 illustrate that the main chamber 52 comprises a rear portion 150, a central portion 152, a first side portion 154, a second side portion 156, and an outlet portion 158. The central portion 152 in turn defines a central inlet portion 160, a central intermediate portion 162, and a central main portion 164. Each of the first and second side portions 154 and 156 define a side inlet portion 170, a side intermediate portion 172, and a side outlet portion 174. The central inlet portion 160 and the side inlet portions 170 are each in fluid communication with the main inlet 58, and the central main portion 164 and the side main portions 174 are each in fluid communication with the outlet portion 158. The outlet portion 158 is in turn in fluid communication with the main outlet 58.

In the example main housing 50, the battery chamber 54 is arranged above the central main portion 164 and between the central side portions 172 defined by the first and second side portions 154 and 156. This arrangement of the battery chamber 54 provides space for the battery assembly 60 while minimizing a height of the main housing 50 and maintaining adequate air flow through the main chamber 52.

Figure 15:
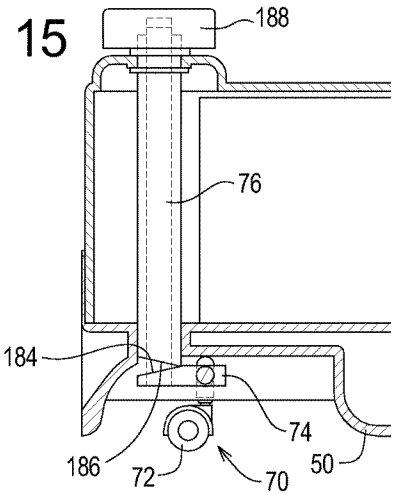
FIGS. 14 and 15 are side elevation, partial cutaway views depicting a wheel lift assembly of the first example power head in lowered and raised configuration, respectively.
Figure 14:
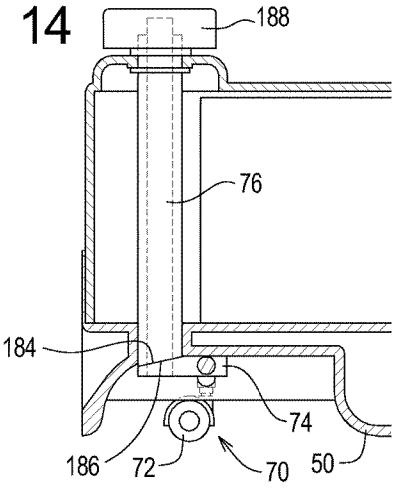
Figure 16:
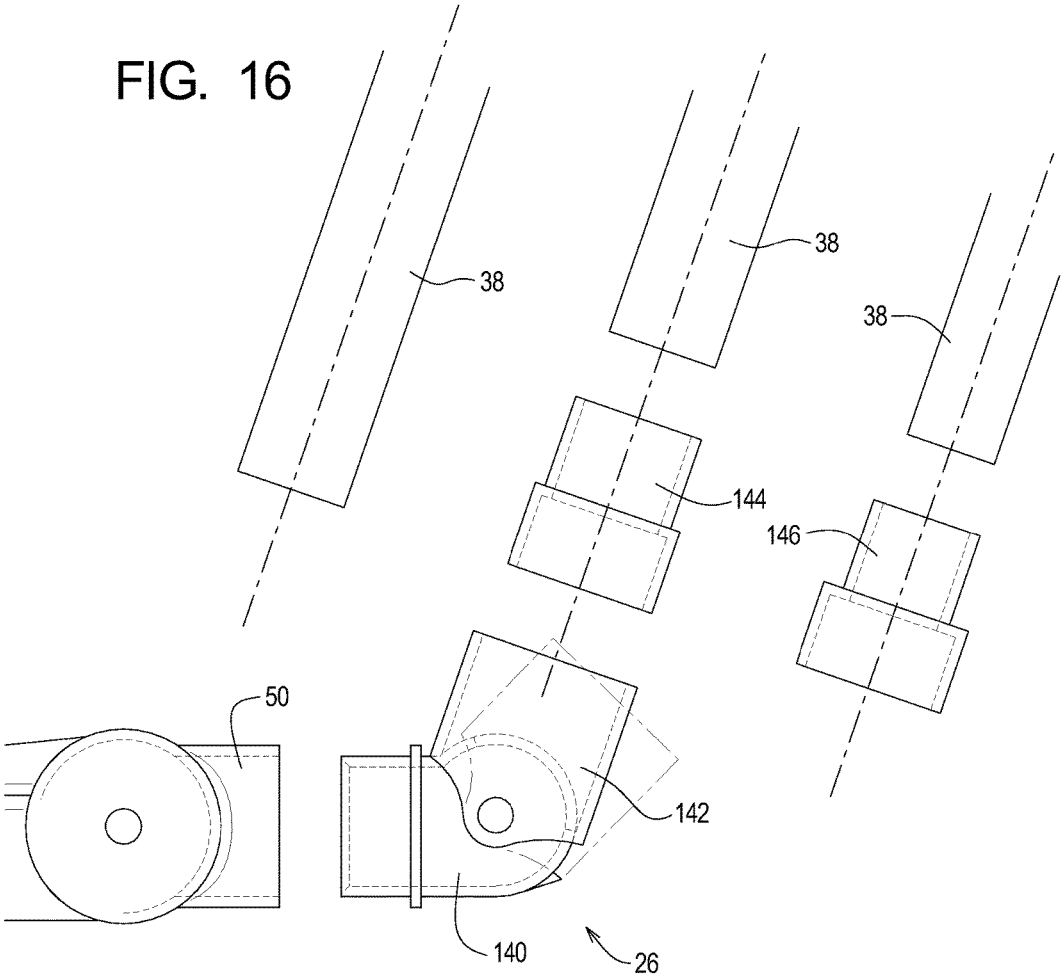
FIG. 16 is a side elevation view depicting a handle adapter system that may be used with the first example power head.

Referring now to FIGS. 9 and 13-15, the example wheel assembly 70 will be described in further detail. The wheel carriage 74 defines first and second wheel hubs 180 and 182 each supporting one of the wheels 72. A carriage cam surface 184 is formed on the wheel carriage 74, and a shaft cam surface 186 is formed on the wheel shaft 76. The cam surfaces 184 and 186 are sized, dimensioned, and arranged such that axial rotation of the wheel shaft 76 displaces the wheel carriage 74 between a fully retracted position (FIG. 14) and a fully extended position (FIG. 15). A knob 188 on the wheel shaft 76 facilitates axial rotation of the wheel shaft 76. When the brush housing 80 is attached to the main housing 50, axial rotation of the wheel shaft 76 thus allows the height of the brush inlet 84 and brush 90 relative to the floor surface supporting the wheels 72. The wheel assembly 70 thus allows the power head system 20 to be reconfigured to be adapted to accommodate different floor materials.

Figure 10:
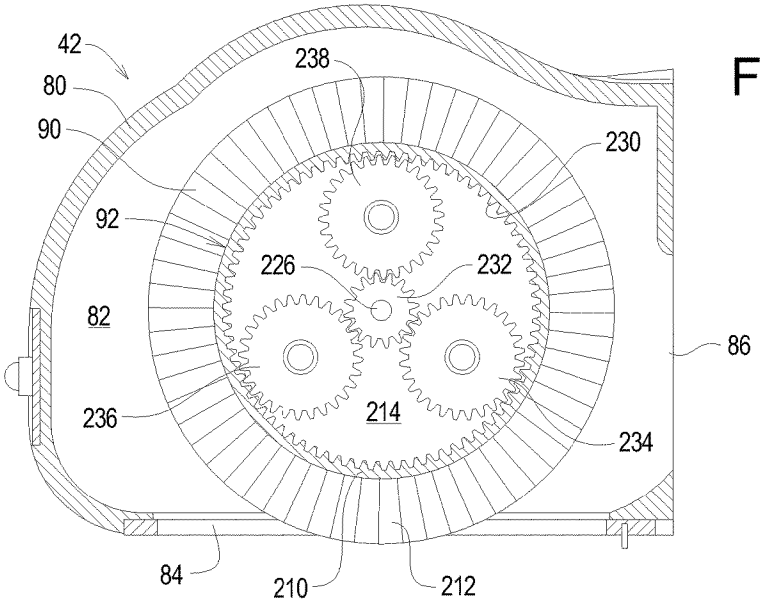
FIG. 10 is a detail view of a portion of the first example power head as depicted in FIG. 9 illustrating a first example motor gear assembly.
Figure 12:
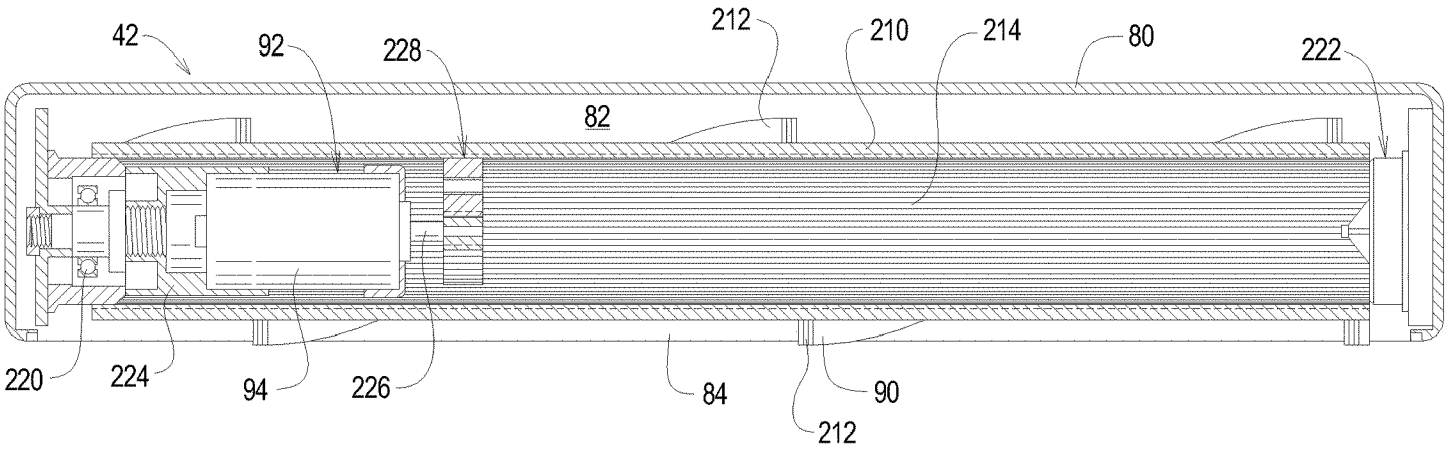
FIG. 12 is a front elevation, cutaway view taken along lines 12-12 in FIG. 3 depicting a brush motor assembly of the first example power head.

Referring now in more detail to the brush drive assembly 92, FIGS. 10 and 12 illustrate that the brush 90 defines a brush axle 210 and bristles 212 outwardly extending from the brush axle 210. Conventionally, the bristles 212 are arranged in one or more spiral patterns centered about a longitudinal axis of the brush axle 210. FIGS. 10 and 12 further illustrate that the brush axle 210 defines an axle chamber 214.

FIGS. 10 and 12 further illustrate that the brush drive assembly 92 further comprises a first bearing 220, a second bearing 222, and a motor mount 224. The example first and second bearings 220 and 222 support the brush 90 within the brush chamber 82 for axial rotation relative to the brush housing 80, and the example motor mount 224 supports the brush motor 94 within axle chamber 214 defined by the brush axle 210 of the brush 90 such that a motor shaft 226 is substantially aligned with a longitudinal axis of the brush 90. The example brush drive assembly 90 further comprises a transmission 228 comprising a ring gear 230, a drive gear 232, and first, second, and third planetary gears 234, 236, and 238. The ring gear 230 is rigidly secured to an interior surface of the brush 90, and the drive gear 232 is rigidly secured to the motor shaft 226. The first, second, and third planetary gears 234, 236, and 238 are arranged between the drive gear 232 and the ring gear 230 such that rotation of the drive gear 232 causes axial rotation of the brush 90.

FIG. 2B illustrates that the example power head system 20 further comprises a charger 240 that is electrically connected to first and second charger contacts 242 and 244. The example first and second charger contacts 242 and 244 are configured to engage the first and second main contacts 62 and 64 to allow the battery forming a part of the battery assembly 60 to be charged. In particular, the example first and second contacts 242 and 244 take the form of an electrical plug like the example electrical plug formed by the first and second brush contacts 96 and 98.

Figure 17:
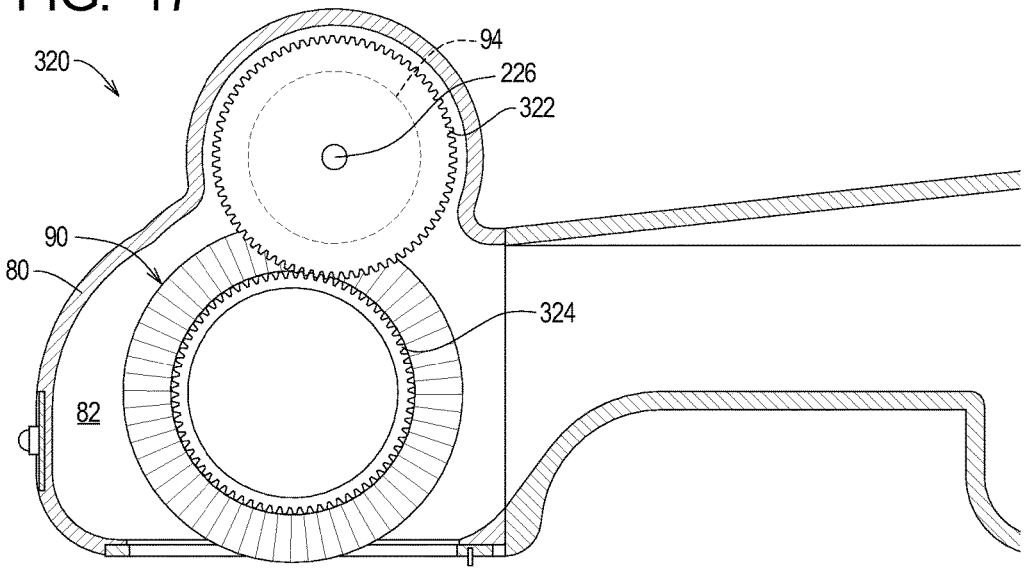
FIG. 17 is a detail, side elevation, cutaway view similar to FIG. 10 depicting a portion of a second example power head comprising a second example motor gear assembly.

FIG. 17 illustrates a second example power head 320 in which the brush motor 94 is not mounted within the brush 90. In this example, a drive gear 322 is mounted on the motor shaft 226. The brush motor 94 is mounted relative to the brush housing 80 such that the drive gear 322 is arranged within the brush chamber 82 and substantially above the brush 90. A ring gear 324 is rigidly connected to the brush 90 and arranged to engage the drive gear 322. Rotation of the brush motor 94 causes rotation of the drive gear 322, which in turn rotates the ring gear 324 to cause axial rotation of the brush 90.

Figure 18:
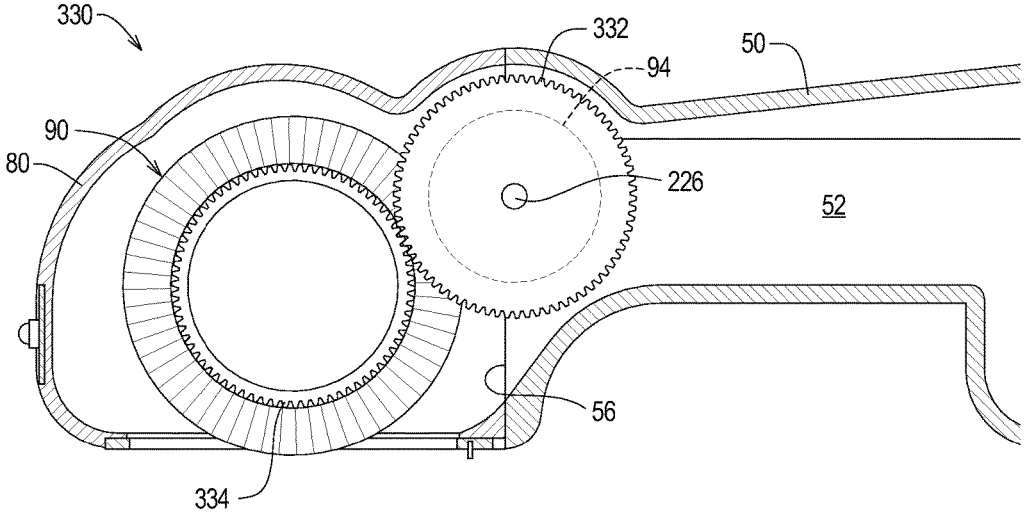
FIG. 18 is a is a detail, side elevation, cutaway view similar to FIG. 10 depicting a portion of a third example power head comprising a third example motor gear assembly.

FIG. 18 illustrates a third example power head 330 in which the brush motor 94 is not supported by the brush housing 80. In this example, the brush motor 94 is supported by the main housing 50. A drive gear 332 is mounted on the motor shaft 226, and the brush motor 94 is mounted relative to the brush housing 80 such that the drive gear 332 is arranged partly within the main chamber 52 and partly such that a portion of the drive gear 332 extends out of the main chamber 52 through the main inlet 56. A ring gear 334 is rigidly connected to the brush 90 and arranged to engage the drive gear 332 when the brush housing 80 is attached to the main housing 50. Rotation of the brush motor 94 causes rotation of the drive gear 332, which in turn rotates the ring gear 334 to cause axial rotation of the brush 90.

What is claimed is:

1. A power head for use with a vacuum system comprising:

a main body assembly comprising a main housing defining a main chamber defining a main inlet and a main outlet, and first and second main contacts supported by the main housing and operatively connected to a power supply;

a brush assembly comprising a brush housing defining a brush chamber, a brush inlet, and a brush outlet, a brush defining an axle chamber, first and second bearings arranged to support the brush within the brush chamber for rotation relative to the brush housing, a motor comprising a motor shaft, where the motor is supported by the brush housing such that the motor shaft is arranged within the axle chamber;

a motor gear assembly arranged within the axle chamber and operatively connected between the motor shaft and the brush such that operation of the motor causes rotation of the brush assembly relative to the brush housing;

first and second brush contacts supported by the brush housing and operatively connected to the motor;

a latch system for detachably attaching the brush assembly to the main body assembly such that the main inlet portion of the main chamber is in fluid communication with the brush outlet, and the first and second main contacts are in contact with the first and second brush contacts;

wherein when the vacuum system is operatively connected to the main housing and the latch system detachably attaches the main housing to the brush housing, the vacuum system draws air through the brush inlet, the brush chamber, the brush outlet, the main inlet, the main chamber, and the main outlet; and the power supply supplies power to the motor such that the motor rotates the brush assembly relative to the brush housing.

2. A power head as recited in claim 1, further comprising:

a battery chamber is arranged between a rear portion of the main chamber and the main inlet, where the battery chamber is arranged between a first side portion of the main chamber and a second side portion of the main chamber; and a battery arranged within the battery chamber and operatively connected to the first and second main contacts.

3. A power head as recited in claim 2, in which:

the main chamber further defines a central portion; and the battery chamber is arranged above at least a portion of the central portion.

4. A power head as recited in claim 1, in which:

the main chamber further defines a central portion; and a battery chamber is arranged above at least a portion of the central portion.

5. A power head as recited in claim 1, in which the motor gear assembly comprises:

a drive gear operatively connected to the motor shaft;

a ring gear formed on an interior surface of the brush; and a plurality of planetary gears; wherein the planetary gears transfer rotation of the drive gear to the ring gear.

6. A power head as recited in claim 1, in which the ring gear is rigidly secured to the interior surface of the brush.

7. A power head as recited in claim 1, in which:

the brush comprises a brush axle defining the axle chamber and bristles outwardly extending from the brush axle; and at least a portion of the motor is arranged within the axle chamber.

8. A power head as recited in claim 1, in which:

the brush comprises a brush axle defining the axle chamber and bristles outwardly extending from the brush axle; and the motor is supported within the axle chamber.

9. A method of directing air and debris into a vacuum system comprising:

providing a main body assembly comprising a main housing defining a main chamber defining a main inlet and a main outlet, and first and second main contacts supported by the main housing and operatively connected to a power supply;

providing a brush assembly comprising a brush housing defining a brush chamber, a brush inlet, and a brush outlet, a brush defining an axle chamber;

first and second bearings arranged to support the brush within the brush chamber for rotation relative to the brush housing, and a motor comprising a motor shaft, where the motor is supported by the brush housing such that the motor shaft is arranged within the axle chamber;

a motor gear assembly arranged within the axle chamber and operatively connected between the motor shaft and the brush such that operation of the motor causes rotation of the brush assembly relative to the brush housing;

detachably attaching the brush assembly to the main body assembly such that the main inlet portion of the main chamber is in fluid communication with the brush outlet, and the first and second main contacts are in contact with the first and second brush contacts;

operating the vacuum system to draw air through the brush inlet, the brush chamber, the brush outlet, the main inlet, the main chamber, and the main outlet; and connecting the power supply to the motor such that the motor rotates the brush assembly relative to the brush housing.

10. A method as recited in claim 9, in which the step of providing the main housing comprises the steps of:

arranging a battery chamber between a rear portion of the main chamber and the main inlet;

arranging the battery chamber between a first side portion of the main chamber and a second side portion of the main chamber;

arranging a battery within the battery chamber; and operatively connecting the battery to the first and second main contacts.

11. A method as recited in claim 10, in which the step of providing the main housing comprises the step of arranging the battery chamber above at least a portion of a central portion of the main chamber.

12. A method as recited in claim 10, in which the step of providing the motor gear assembly comprises the step of rigidly securing the ring gear to the interior surface of the brush.

13. A method as recited in claim 9, in which the step of providing the main housing comprises the step of arranging a battery chamber above at least a portion of a central portion of the main chamber.

14. A method as recited in claim 9, in which the step of providing the motor gear assembly comprises the steps of:

operatively connecting a drive gear to the motor shaft;

forming a ring gear on an interior surface of the brush;

arranging a plurality of planetary gears to transfer rotation of the drive gear to the ring gear.

15. A method as recited in claim 9, in which the step of providing the brush comprises the step of providing a brush axle defining the axle chamber and bristles outwardly extending from the brush axle, the method further comprising the step of arranging at least a portion of the motor within the axle chamber.

16. A method as recited in claim 9, in which the step of providing the brush comprises the step of providing a brush axle defining the axle chamber and bristles outwardly extending from the brush axle, the method further comprising the step of arranging the motor within the axle chamber.

17. A vacuum system comprising:

a vacuum source;

a hose connected to the vacuum source;

a handle connected to the hose;

an extension tube connected to the handle;

a power head comprising a main body assembly comprising a main housing defining a main chamber defining a main inlet and a main outlet, and a battery chamber, and a battery arranged in the battery chamber;

a brush assembly comprising a brush housing defining a brush chamber, a brush inlet, and a brush outlet, a brush rotatably supported within the brush chamber, and a motor arranged to rotate the brush assembly relative to the brush housing;

a latch system for detachably attaching the brush assembly to the main body assembly such that the main inlet portion of the main chamber is in fluid communication with the brush outlet, and the battery is operatively connected to the motor;

wherein when the extension tube is detachably attached to the main housing and the latch system detachably attaches the main housing to the brush housing, the vacuum source draws air through the brush inlet, the brush chamber, the brush outlet, the main inlet, the main chamber, the main outlet, the extension tube, the handle, and the hose; and the battery supplies power to the motor such that the motor rotates the brush assembly relative to the brush housing.

18. A vacuum system as recited in claim 17, further comprising a charger, where the latch system further detachably attaches the brush assembly to the charger to charge the battery.

* * * * *